US007040613B2

(12) United States Patent
Vedoy

(10) Patent No.: US 7,040,613 B2
(45) Date of Patent: May 9, 2006

(54) COMPUTER CONTROLLED SHEET FEEDER

(75) Inventor: Arild Vedoy, White Bear Lake, MN (US)

(73) Assignee: Multifeeder Technology, Inc., White Bear Lake, MN (US)

( * ) Notice: Subject to any disclaimer, the term of this patent is extended or adjusted under 35 U.S.C. 154(b) by 300 days.

(21) Appl. No.: 10/625,782

(22) Filed: Jul. 23, 2003

(65) Prior Publication Data

US 2005/0017443 A1 Jan. 27, 2005

(51) Int. Cl.
*B65H 5/00* (2006.01)

(52) U.S. Cl. ..... 271/10.07; 271/272; 271/273

(58) Field of Classification Search ..... 271/10.07, 271/273, 272, 117, 265.04
See application file for complete search history.

(56) References Cited

U.S. PATENT DOCUMENTS 4,557,472 A * 12/1985 Hannon ..... 271/133
4,702,467 A * 10/1987 Hannon ..... 271/133
4,919,413 A * 4/1990 Hannon ..... 271/133
5,924,687 A * 7/1999 Hannon ..... 271/116
6,050,563 A 4/2000 Vedoy et al. ..... 271/10.07
6,102,390 A * 8/2000 DeFigueiredo et al. ..... 271/124

* cited by examiner

*Primary Examiner*—Donald P. Walsh
*Assistant Examiner*—Kaitlin Joerger
(74) *Attorney, Agent, or Firm*—Nikolai & Mersereau, P.A.

(57) ABSTRACT

A sheet feeder having parallel opposing shafts with rollers or belts for engaging sheets. The sheet feeder having one control to adjust the height of both sides of one shaft so that the rollers apply the same force to both sides of the sheet to feed the sheet straight preventing the sheets from jamming in the sheet feeder. The sheet feeder can have manual or electronic height adjustments. The gap between the shafts can be quickly and easily changed for quickly changing production runs with different thickness product. The shafts are three-piece shafts for ease of changing the rollers on the shaft. All the bearings are pregreased and sealed to protect the bearings from dirt and debris. Rods connect the height adjustment on both sides of the shaft so both sides are adjusted by the same amount at the same time.

20 Claims, 7 Drawing Sheets

COMPUTER CONTROLLED SHEET FEEDER

BACKGROUND OF THE INVENTION

This invention relates to product thickness adjustments on sheet feeding machines, and particularly to a single knob adjustments with optional computer controls.

DESCRIPTION OF THE RELATED ART

Presently it is difficult to set the stripper wheel shafts on both sides of a sheet-feeding machine to the same height. If the stripper wheels are not positioned to engage and separate sheets with the same force on both sides of a sheet, the sheet will feed crooked which may damage the sheets and or jam the sheet-feeder. If the shafts are not at the same height a parallel force will be placed on the bearings due to a misalignment which will reduce the life of the bearings and increase the power needed to run the sheet feeder while increasing vibrations, noise and belt and roller wear.

Further, the stripper wheels need to be periodically replaced. Currently it is a difficult job to disassemble the stripper machine and replace the stripper wheels and belts. The down time on the machine and the skill level of the maintenance person make the job unnecessarily expensive.

Since each different product sent though a sheet-feeding machine has a different thickness and since the stripper wheels wear over time frequent adjustments for the settings of the stripper wheels are required.

It is also a common problem for the current sheet feeding machines to need maintenance for oiling the gears, cleaning dust and debris from the drive mechanisms and replacing parts, which wear out faster if not properly maintained. A lower maintenance machine with longer life is desired, which can be serviced at longer intervals by lower skill workers.

In prior art designs springs were used to keep tension on the shafts for the stripper wheels and for providing even force on the belts. When a machine is new the springs have the right elasticity to maximize the efficiency of the sheet feeder but over time the spring losses elasticity reducing the machine's precision and the springs eventually need to be replaced.

Many parts require lubrication to work at maximum efficiency. As the lubrication becomes dirty or degrades the lubrication deteriorates which contributes to excessive wear and increases vibration and noise. As the lubrication gets dirty friction increases which the springs are supposed to overcome.

In prior art sheet feeding machine's vibrations and differing accelerations caused by worn gear teeth or poor meshing of gear teeth over a range of shaft height adjustments can result in jerky movements of a shaft as power is not smoothly transferred from one gear to another, which can promote wear on the machine and jamming of the product being fed. The springs when they are new can stabilize some of the vibrations however as the springs get old they do not prevent these problems.

Bearings and gears in prior art machines may not have tight fits and are exposed to dirt and debris which limits the life of the parts and introduces undesirable vibrations reducing the efficiency of the machine, limiting its life and creating noise while contributing to product jamming and product damage.

Shorter production runs generate more frequent changeovers between products demanding simpler adjustments for changeover and setup.

Prior art sheet feeders used one adjustment knob on each side of the sheet feeder to allow the independent adjustment of the stripper wheel force on each side of the machine. However the operator has no way of knowing when the stripper wheels exert the same force on each side of the sheet or the same force on the belts on each side. One problem experienced by operators is that there are a multitude of adjustments that when misadjusted show symptoms as if the stripper wheels have uneven pressure such as skewed product. If the operator then adjusts the position of the stripper wheel shafts when they were properly set the product will become crooked and the problems will get worse. It is difficult to diagnose and correct these problems. It is therefore desirable to have both ends of the stripper wheel shaft automatically set to the same height on both sides of the product.

An improved sheet-feeding machine is needed to overcome the above problems and to improve the manual setting of the stripper wheels and provide for programmable settings of shaft positions to accommodate changes in product thickness.

SUMMARY OF THE INVENTION

The sheet-feeder has opposing housings containing sliding blocks for the simultaneous vertical adjustment of shafts by turning ball screws in each housing. A rod connects the ball screws on the opposing housings so that both ball screws are turned in unison to ensure both are adjusted to the same height.

Stripper wheels for the sheet feeder are on a three-piece shaft. The stripper wheel portion of the shaft connects to axels in bearings within sliding blocks. The three-piece shaft allows the stripper wheels portion of the shaft to be replaced without having to disassemble the housings or remove the shafts from the press fit ball bearings. With shaft ends permanently in the bearings secured in housings the bearings are protected from dust, dirt and debris, while sealing in the oil or grease needed for uncontaminated lubrication of the bearings. The three-part shaft allows a quick and easy replacement of the stripper wheels without a highly skilled technician. The sealed housings prevent dust, dirt and debris from entering the moving parts of the sheet feeder mechanism resulting a longer life sheet feeder with less maintenance required. Better alignment of the shafts allows the sheet feeder to run smoother with less noise and less vibration, reduces damage to product and jamming of sheets in the sheet feeder and extends bearing life.

The sheet feeder can adjust the position of the stripper wheels by programmable electronic controls to further improve the efficiency of operating the machine without having to manually set the position of the stripper wheels. Electronic measurement of the position of the adjustable shafts in sheet feeder can be used to manually make adjustments of the sheet-feeding machine.

A side mounted discharge drive assembly having a spur gear with extended teeth adjacent an adjustable height spur gear having extended teeth to smoothly transfer power over an increased range without introducing jerky motion of accelerations to a shaft being driven by the adjustable height spur gear.

The sheet feeder has stripper wheels with a single adjustment to uniformly position the stripper wheels at even positions on either side of the sheet feeder. The even adjustment prevents the shaft from placing forces on the bearings due to alignment problems. Proper alignment increases the life of the bearings, reduces vibrations and noise and reduces the energy needed to run the sheet-feeding machine.

Having the bearings in sealed housings enables the sheet-feeding machine to operate in a dirty environment without the bearings being exposed to dirt and debris. Having a cleaner bearing preserves the quality of the lubrication and extends the life of the bearing. Ball bearings are also superior to needle roller bearings for providing tighter alignment and longer life.

The three-piece shafts promote easy access to the sheet feeder for clearing jams and performing maintenance.

The three-piece rods allow for calibration of parallelism of the shafts.

The disclosed sheet feeder has modular parts for easy assembly and replacement of parts and for ease of maintenance.

The automatic alignment of both the rollers on both sides of the sheet feeder allow for quick and easy setups for running product of different thicknesses through the sheet feeder.

OBJECTS OF THE INVENTION

It is an object of the invention to provide a single adjustment for accurately positioning the stripper wheels on a sheet-feeding machine.

It is an object of the invention to provide for easier maintenance.

It is an object of the invention to provide a quick and easy change over between runs when different size product is being fed into the sheet feeder.

It is an object of the invention to provide a more robust sheet feeder.

It is an object of the invention to have encased protected bearings for long life and low maintenance.

It is an object of the invention to easy replacement stripper wheels.

It is an object of the invention to have shafts ends permanently in bearings.

It is an object of the invention to provide sealed ball bearings to keep the bearings and lubrication cleaner which reduces wear.

It is an object of the invention to provide fans in the housings for positive internal pressure to keep dirt and debris out of the housing.

It is an object of the invention to provide automatic height adjustments to programmed settings.

It is an object of the invention to provide even and accurate manual height adjustments.

It is an object of the invention to provide easy to replace belts and rollers on shafts.

It is an object of the invention to modularize the maintenance and repairs to reduce down time.

It is an object of the invention to increase the life of the sheet feeder.

It is an object of the invention to reduce damage to the sheets.

It is an object of the invention to reduce jamming.

It is an object of the invention to reduce vibrations and noise.

Other objects, advantages and novel features of the present invention will become apparent from the following description of the preferred embodiments when considered in conjunction with the accompanying drawings.

DESCRIPTION OF THE PREFERRED EMBODIMENTS

Figure 1:
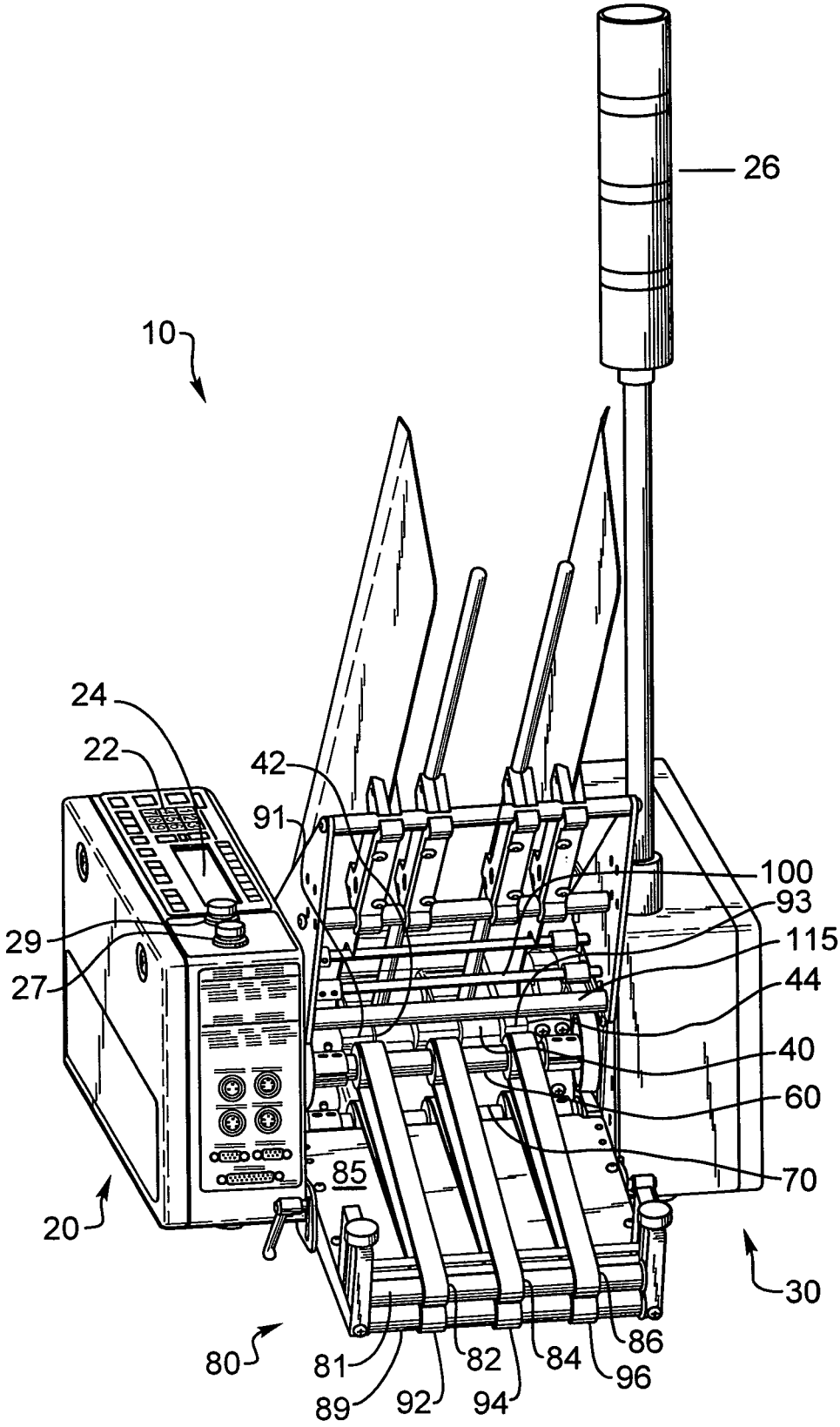
FIG. 1 is a rear view of the sheet feeder.
Figure 2:
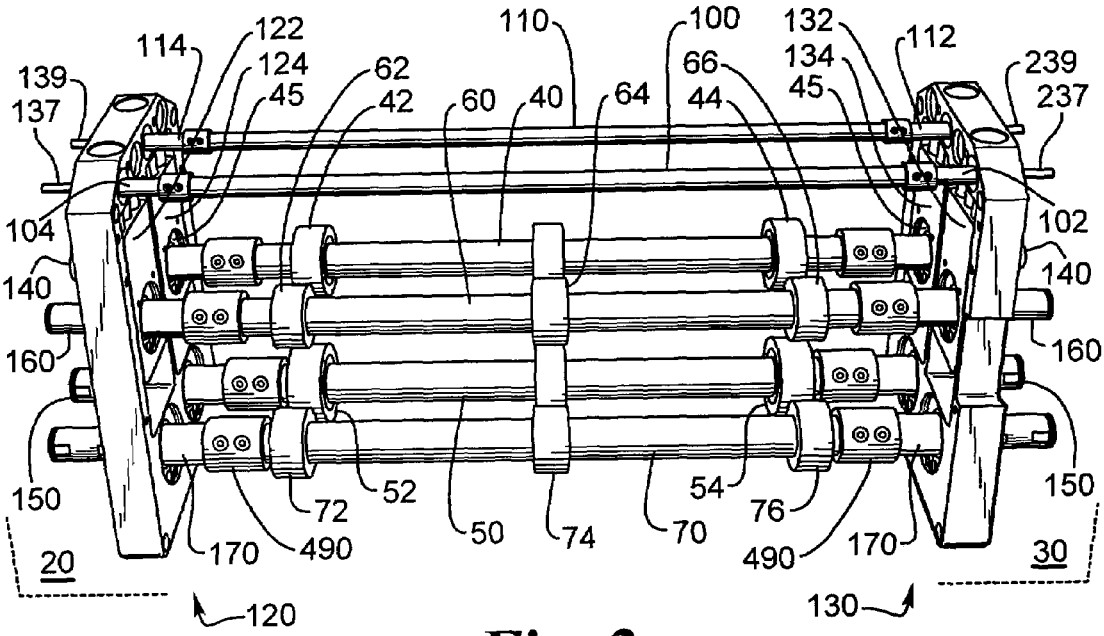
FIG. 2 is a perspective view of the sheet feeder shafts and bearing assemblies.
Figure 3:
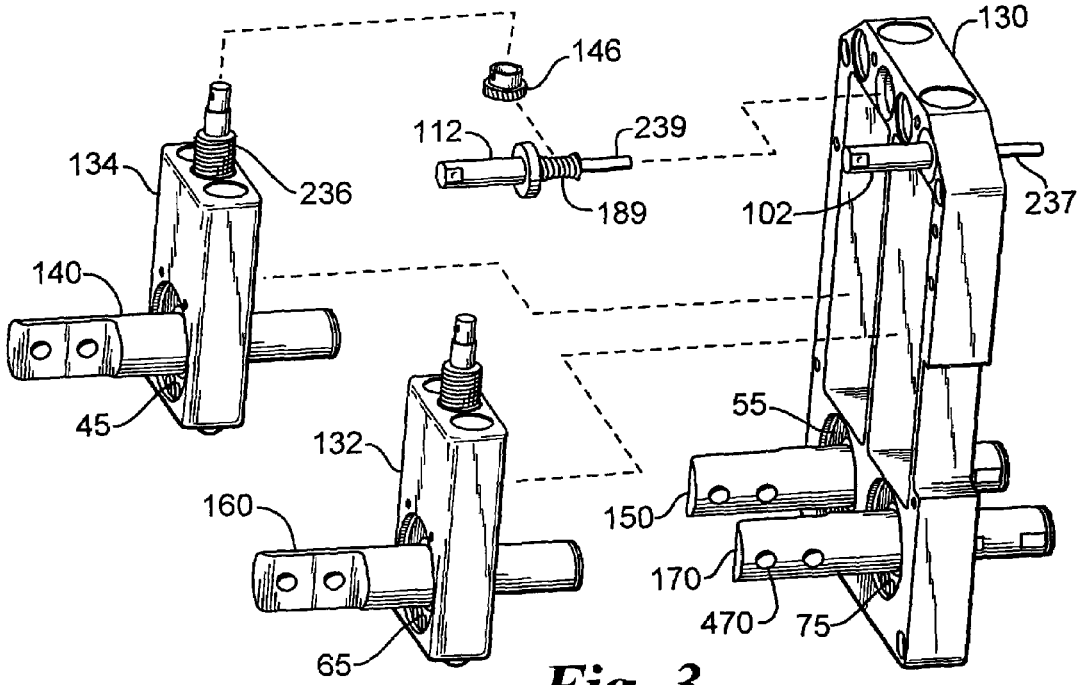
FIG. 3 is a perspective view of the left bearing assembly with sliding blocks not yet installed.

The sheet feeder 10 has an adjustable height upper stripper wheel shaft 40 and an adjustable height upper discharge belt drive shaft 60. The height of the upper stripper wheel shaft 40 is adjustable by turning knob 29 on the top of the right side housing 20 or by programming the desired height in a controller 195 by use of keypad 22. Knob 29 is mechanically connected to a worm shaft 139 on the right bearing assembly 120 and to a worm shaft 239 on the left bearing assembly 130 by an adjustment rod 110 for turning both ball screws 236 at the same rate and at the same time to adjust the height of the upper stripper wheel shaft 40 at both ends so that the upper stripper wheel shaft 40 remains parallel to the opposing lower discharge belt drive shaft 50. The upper discharge belt drive shaft 60 is similarly adjusted relative to the lower discharge belt drive shaft 70 by means of knob 27.

The upper stripper wheel shaft 40, the upper discharge belt drive shaft 60 and the rods 100 and 110 are all three-piece shafts and three piece rods so that they can be easily attached or removed for ease of maintenance. The three-piece rods also allow for the calibration of parallelism of the stripper wheel shaft 40 with respect to the feed belt drive shaft 50 by adjusting rod 110. Similarly upper discharge belt drive shaft 60 and lower discharge belt drive shaft 70 are adjusted by rod 100. With a coupler disconnected the rods 100 or 110 can adjust the height of one side of the rod with respect to the other side.

Figure 8:
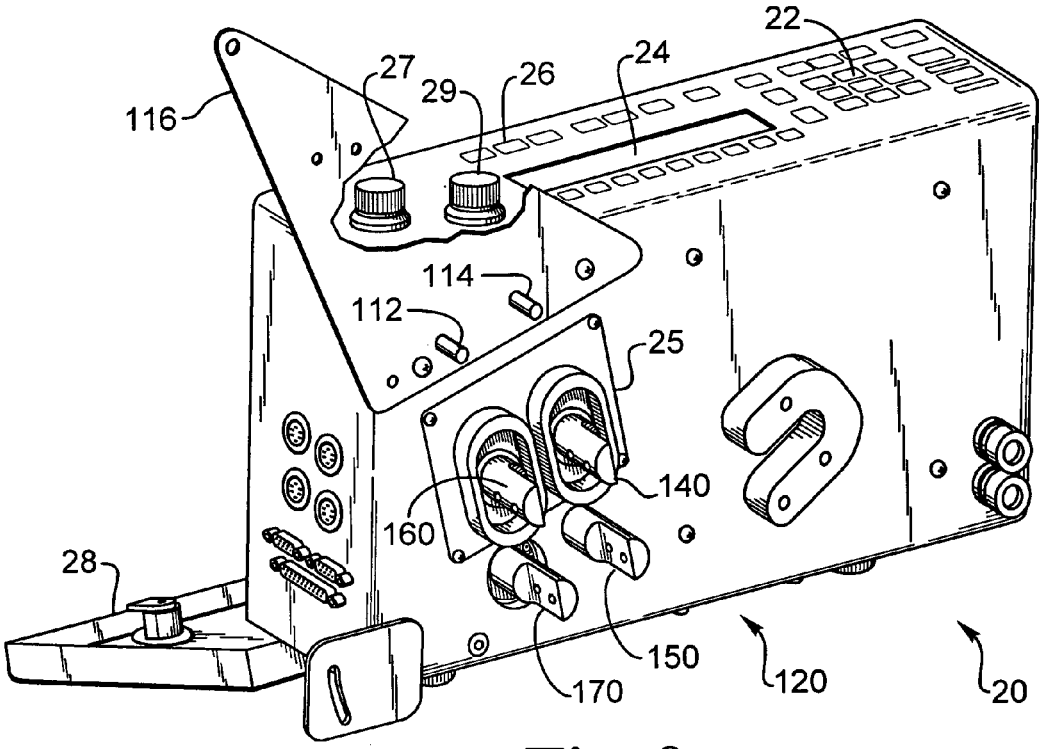
FIG. 8 is a perspective view of the shaft side of the right side housing.

The sheet feeder 10 is shown generally in FIG. 1. It has a right side housing 20 and a left side housing 30. A right bearing assembly 120 is attached to the right side housing 20 and a left bearing assembly 130 is attached to the left side housing 30. An upper stripper wheel shaft 40 having rollers 42 and 44 extends between the right bearing assembly 120 and the left bearing assembly 130. The sheet feeder 10 also has a lower discharge belt shaft 50 with belt drive rollers 52 and 54 extending between the right bearing assembly 120 and the left bearing assembly 130 directly below the upper stripper wheel shaft 40. When a sheet is fed through the sheet feeder it passes between opposing rollers 42, 44 and belts on belt drive rollers 52 and 54 respectively which engage and move the sheet by applying pressure thereon, as best seen in FIG. 8 of U.S. Pat. No. 6,050,563 incorporated herein by reference showing belts 38 on the lower shaft. The upper stripper wheel shaft 40 is adjustable relative to the fixed position lower discharge belt shaft 50 to allow for sheets of varying thickness to be processed in different production runs. Further, since the rollers 42, 44, and belts on belt drive rollers 52 and 54 will wear over time the adjustable position upper stripper wheel shaft 40 can be lowered to compensate for the rollers 42, 44 diminishing diameter and the belts diminishing thickness. Belts 91 and 93 on the lower stripper wheel shaft 40 are used to move the sheets in the sheet feeder 10.

It is important that the adjustable upper stripper wheel shaft 40 remain parallel to the lower discharge belt shaft 50 along its entire length. To ensure equal movement both ends of the upper stripper wheel shaft 40, both ends are moved up and down in unison by the same distance so that the gap between the rollers 42, 44 and belts on belt drive rollers 52 and 54 remain equal. If the gaps are not equal the sheet being fed will not be gently separated from the stack of product and will be torqued, promoting a misfeed, leading to jamming the sheet feeder 10, damaging the sheet being fed or both.

Turning knob 29 on the right housing 20 turns universal joint 329, which is connected to worm shaft 139 on right bearing assembly 120. Worm shaft 139 also has a rod connecting portion 114, which is connected to rod 110. Rod 110 is connected to the rod-engaging portion 112 of worm shaft 239 on left bearing housing 130. Worm shaft 239 has a threaded portion 189, which engages and turns worm gear 146. Worm gear 146 engages and turns ball screw 236 whose threads engage threads in bearing block 134 to raise and lower it in left bearing assembly 130. The right bearing assembly 120 has a mirror image mechanism for uniformly and simultaneously raising and lowering bearing block 124 when worm shaft 139 is turned. The sliding block 124 in the right bearing block 120 and the sliding block 134 in the left bearing block 130 both have roller bearings 45, for holding shafts 140 which connect to upper stripper wheel shaft 40. The sliding blocks 124, 134 preferably have sealed roller bearings 45 with lubricants sealed therein to protect the roller bearings 45 and the lubricant from dust, dirt and debris.

Thus turning knob 29 will raise or lower sliding blocks 124 and 134 by equal distances simultaneously which raises and lowers the upper stripper wheel shaft 40 while maintaining it parallel to the lower discharge belt shaft 50.

Similarly, upper discharge belt drive shaft 60 has rollers 62, 64, 66 engaging belts 82, 84 and 86 and lower discharge belt shaft 70 has rollers 72, 74, 76 engaging belts 92, 94, 96 for moving sheets onto discharge table 80. The upper discharge belt drive shaft 60 is adjustable to vary the gap with the lower discharge shaft belt shaft 70 so that the belts 82, 84, 86 and 92, 94, 96 have an adjustable gap between them for moving and discharging sheets from the sheet feeder 10. It is important that the adjustable upper discharge belt drive shaft 60 moves up and down by the same distance on both ends in unison so that the upper discharge belt drive shaft 60 and the lower discharge belt shaft 70 remain parallel such that the opposing belts engage with the same force, so they will not torque the sheets, promoting a misfeed leading to jamming the sheet feeder or damaging the sheet being fed.

To obtain uniform height adjustments on both sides of shaft 60 a knob 27 adjusts both sides of the shaft 60 simultaneously by the same distance. Turning knob 27 turns universal joint 327 which turns worm shaft 137. Worm shaft 137 has a rod connection portion 104 for attachment to rod 100. Rod 100 is also attached to rod connection portion 102 on worm shaft 237 on left bearing assembly 130, which turns a threaded portion 189 for turning a worm gear 146 on ball screw 236 whose threads extend into threads in sliding block 132 in the left bearing assembly 130. Pin 137 has a threaded portion 189, which engages and rotates worm gear 146 in sliding block 122 to raise and lower the sliding block 122 in right bearing assembly 120. The sliding block 122 in the right bearing block 120 and the sliding block 132 in the left bearing block 130 both have roller bearings 65 and 75 for holding shafts 160 and 170 which connect upper discharge belt drive shaft 60. The bearing blocks 120 and 130 preferably have sealed roller bearings with lubricants sealed therein to protect the roller bearings and the lubricant from dust, dirt and debris.

The sliding blocks 122, 132 and 124, 134 may be calibrated such that shafts 60 and 40 respectively are parallel to opposing shafts 70 and 50. To calibrate the shafts rods 100 and 110 may be removed and the sliding blocks 122, 132, 124, 134, moved independently by turning the worm shafts 102, 104, 112 and 114 to set the desired heights of the roller bearing shafts 140 and 160.

The roller bearings 45 and 65 in the sliding blocks 122, 132, 124 and 134, and the roller bearings 55, and 75 in right and left housings 120 and 130 are preferably all pregreased and sealed for the life of the ball bearings. The sealed bearings will be free of dust dirt and other contaminations.

The left and right bearing assemblies 120 and 130 preferably have springs 135 for loading the sliding blocks 122, 124, 132 and 134 therein to ensure they are pushed and pulled evenly by the ball screws 236. The springs 135 also help overcome backlash in the gear assembly and provide anti backlash tension. The springs thus promote even movement of the sliding blocks 122, 124, 132 and 134 in the left and right bearing assemblies 120 and 130 so they will rise and lower at the same time.

The sliding blocks 122, 124, 132 and 134, fit into the right and left bearing housings 120 and 130, snugly so that lateral and horizontal movement of the shafts 40 and 60 are limited. The surfaces between the parts are lubricated to provide for smooth contact while the sliding blocks slide in the bearing housings.

It should be noted that the shafts used for the roller shafts 40 and 50 and the belt discharge shafts 60, 70 may have any number of rollers and associated belts. The drawings for this embodiment show two rollers 42 and 44 and 52 and 54 on the shafts 40 and 50 and three rollers 62, 64, 66 and 72, 74, 76 on the belt discharge shafts 60 and 70 respectively. This configuration is used for illustration purposes only.

Figure 4:
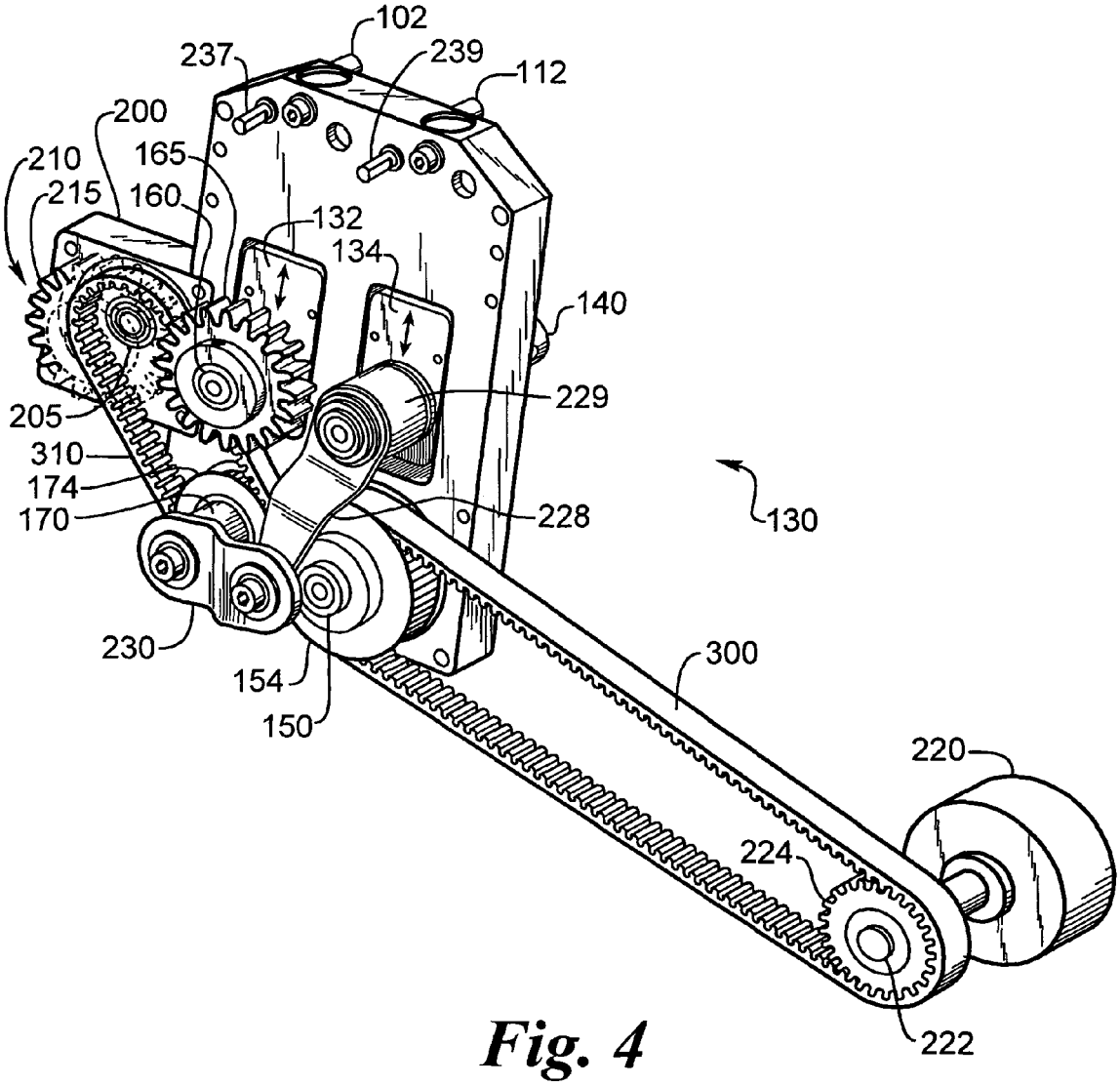
FIG. 4 is a perspective view of the drive side of left bearing assembly with sliding blocks installed.
Figure 5:
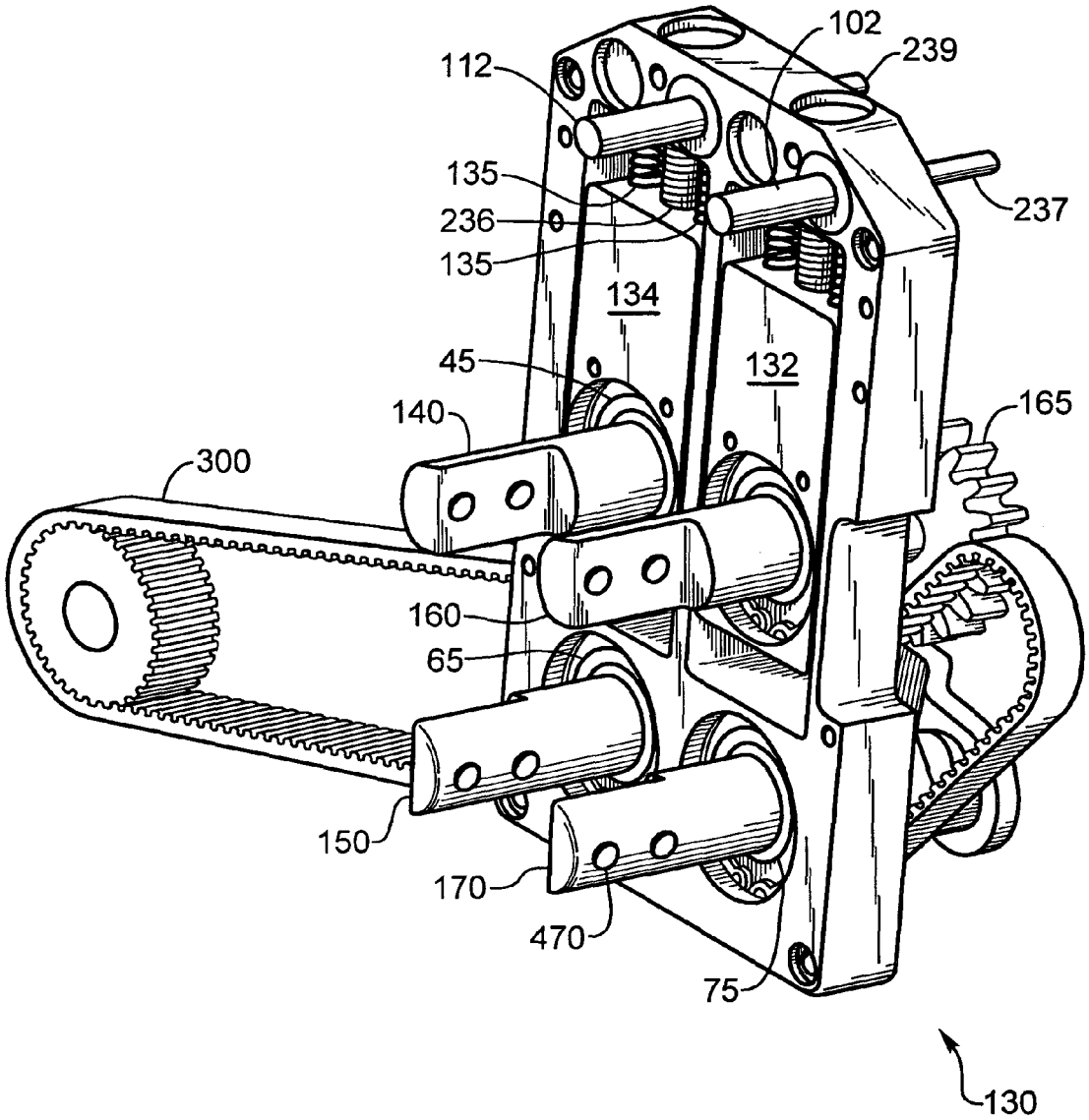
FIG. 5 is a perspective view of the shaft side of left bearing assembly with sliding blocks installed.
Figure 6:
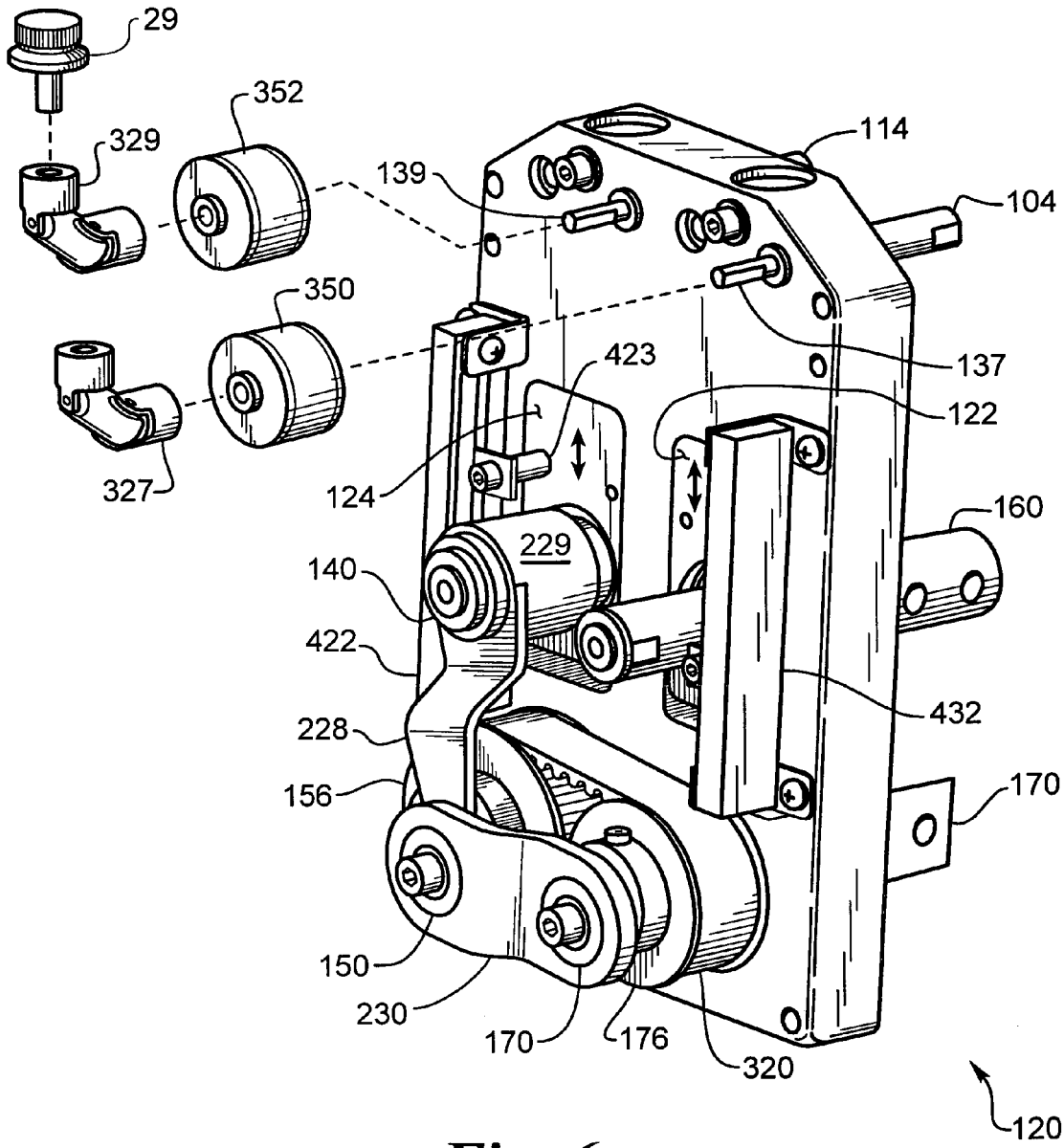
FIG. 6 is a perspective view of the drive side of right bearing assembly with sliding blocks installed.

The shafts 40, 50, 60 and 70 must be driven at controlled speeds and rotate in unison at desired rates. FIGS. 4, 5 and 6 show the drives for the shafts 40, 50, 60 and 70 on right and left bearing assemblies 120 and 130 respectively.

In the embodiment shown power from a motor 220 is transferred from the left bearing housing 130 on ball bearing left end shaft 150 and then through shaft 50 to the right bearing housing 120 and is transferred to ball bearing right end shaft 170 by timing belt 320 to lower belt discharge shaft 70. Both of the ball bearing shafts 170 have crankshaft mechanisms for transmitting power to the ends of ball bearing shafts 140 to turn upper stripper wheel shaft 40 with a smooth constant speed. The crankshaft cam action offset determines the speed of shaft 140 by gear ratio in the reverse direction.

The roller bearing shaft 170 in the left bearing assembly 130 also powers the upper roller bearing shaft 160 on the left bearing assembly 130.

As seen in FIG. 4 a motor 220 which may be controlled as to speed by a controller 195, has a shaft 222 supporting a pulley 224 which engages a timing belt 300 for rotating pulley 154 on roller bearing shaft 150 in left bearing assembly 130. As shown above roller bearing shaft 150 has shaft 50 attached. Shaft 50 is also attached to a roller bearing shaft 150 in right bearing assembly 120. Thus the roller bearing shafts 150 on the right and left roller bearing assemblies 120 and 130 turn at the same rate.

FIG. 6 shows the drive mechanism on right bearing housing 120 where a pulley 156 is attached to the roller bearing shaft 150. Pulley 156 engages and turns timing belt 320, which transfers power to pulley 176 on belt discharge bearing shaft 170. Bearing shaft 170 is connected to lower belt discharge shaft 70 for moving sheets of material. The other end of the lower belt discharge belt shaft 70 is connected to the belt discharge-bearing shaft 170 on left bearing assembly 130. In the embodiment shown the lower and upper discharge belt drive shafts 70 and 60 run at the same speed which is faster than the feed belt drive shaft 50. The belt discharge-bearing shaft 170 runs faster than roller bearing shaft 150 by a set gear ratio (pulley 156/pulley 176) to generate a larger gap between sheets being fed in the discharge section. Both the discharge bearing shafts 170 on the right and left bearing assemblies 120 and 130 turn at the same rate and both are connected to the upper roller bearing shafts 140 on the right and left bearing assemblies 120 and 130 by a crankshaft mechanism to turn the upper stripper wheel shaft 40 at a constant rate.

Roller bearing shaft 170 is attached to upper roller bearing shaft 140 for engaging and moving sheets. The crankshaft mechanism allows the sliding blocks 124, 134 to be raised and lowered while still driving the roller bearing shafts 140. As shown in FIG. 6 for the right roller assembly 120 the roller bearing shaft 170 is attached to a link 230, which pivotally connects to crank arm 228 for rotating roller bearing shaft 140. Roller bearing shaft 140 has a spacer 229 for crank arm 228 to clear pulley 156 on roller bearing shaft 150. As shown in FIG. 4 the left roller assembly 130 has a link 230, which pivotally connects to crank arm 228 for rotating roller bearing shaft 140 and transfers power from roller bearing shaft 170 to roller bearing shaft 140. Roller bearing shaft 140 has a spacer 229 for crank arm 228 to clear pulley 154 on roller bearing shaft 150.

Thus on both sides of the sheet feeder 10 the bearing shaft 170 has a crankshaft mechanism comprising a link 228 and a crank arm 230 for transferring power evenly on both sides of the sheet feeder 10 to the roller bearing shaft 140 as the sliding blocks 124 and 134 slide up and down in bearing assemblies 120 and 130.

On the left bearing assembly 130 roller bearing shaft 170 has a pulley 174 for driving timing belt 310 which is connected to a pulley having an idler spur gear 210 supported on a roller bearing 205 on idler block 200 attached to the side of left bearing assembly 130. The spur gear teeth 215 of the pulley having an idler spur gear 210 engage the teeth on spur gear 165 attached to roller bearing shaft 160 to drive upper discharge belt drive shaft 60. The position of the axel of the roller bearing 205 is in the center of the range of the height adjustment of the sliding block 132. The idler spur gear 210 have elongated teeth 215 to mesh with extended teeth on spur gear 165 to provide a large range of engagement of the teeth with smooth engagement to prevent starting and stopping of the roller bearing shaft 160 which would occur if the teeth did not smoothly mesh due to the distance of the center axels of the spur gears 165 and 210. Roller bearing shaft 160 on sliding block 132 in the left bearing assembly 130 is attached to upper discharge belt drive shaft 60 and which is connected to the roller bearing shaft 160 on sliding block 122 in the right bearing assembly 120.

As shown above the sliding blocks 122, 132 and 124, 134 are raised and lowered in unison by turning knobs 29 and 27 so that the shafts 40 and 60 are aligned with the roller bearings 45 and 65.

To electronically measure the position of the shafts 40 the right bearing assembly has a potentiometer 422 adjacent sliding block 124. Post 423 attached to sliding block 124 slidingly engages the potentiometer 422 to measure the position on shaft 40. Similarly the position of shaft 60 is measured by sliding block 122 having a post which slidingly engages potentiometer 432. The position of the shafts can then be displayed on display 24 and adjusted to desired settings. Further, keypad 22 can receive data for the settings of the position of the shafts 40 and 60 and the controller can adjust the position of the shafts using the resistance measurements from the potentiometers. The controller can store information about desired settings for different sheet thicknesses and the settings recalled and the shaft positions set of different jobs by selecting a set of preprogrammed settings in the controller. A motor 350 on shaft 137 controlled by controller 195 can automatically adjust the position of shaft 60 and a motor 350 on shaft 139 can automatically adjust the position of shaft 40.

Figure 10:
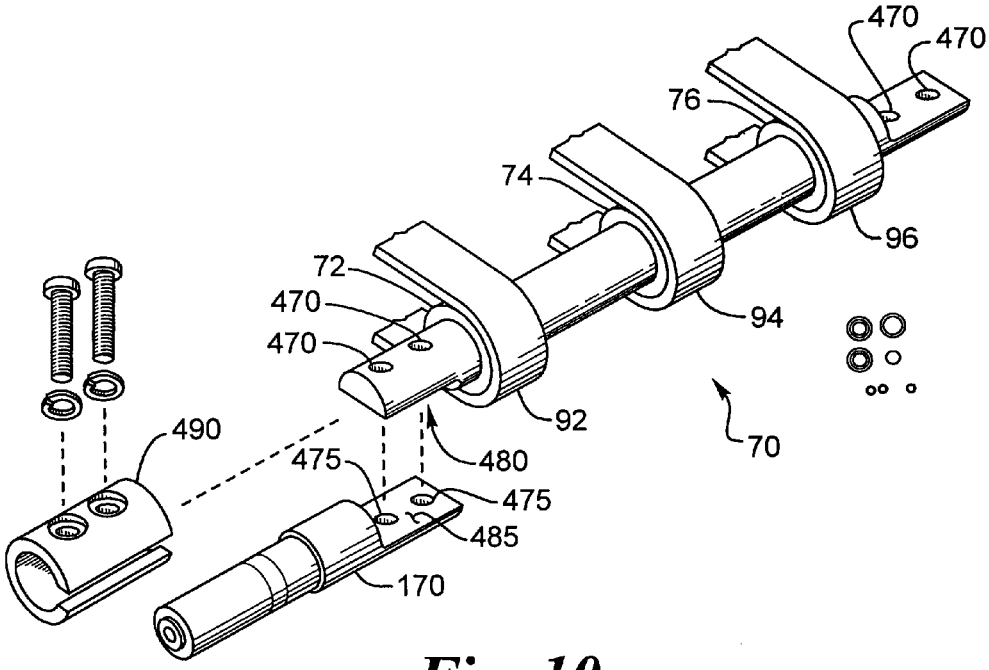
FIG. 10 is a perspective view of a three-piece shaft with rollers.

FIG. 10 shows the three-piece shaft for the roller bearing shaft 170 and lower belt discharge shaft 70. If the rollers 72, 74 or 76 become worn and need replacing or the belts 92, 94, 96 need replacing, the lower belt discharge shaft 70 can be easily removed from the sheet feeder by removing screws, not show, from threaded apertures 470 in the shaft lower belt discharge shaft 70 and from threaded apertures 475 in the roller bearing shaft 170. A new lower belt discharge shaft 70 can be quickly and easily attached to replace the old shaft. In this manner the rollers can be replaced and will be properly aligned or the belts 92, 94, 96 replaced. Other maintenance tasks may also need to have the lower belt discharge shaft 70 removed such as for removing sheet jams, or replacing bearings 75 in the left or right bearing assembly 120, 130.

Similarly three-piece shafts comprising the upper stripper wheel shaft 40 roller and bearing shaft 140 in bearings 45, lower feed belt shaft 50 and roller bearing shaft 150 in bearings 55, and upper discharge belt drive shaft 60 and roller bearing shaft 160 in bearing 65 are easily taken apart or assembled for ease of maintenance.

Rods 100 and 110 are three-piece rods which are also easy to take apart or assemble. The rods 100 and 110 cross from the to right the left bearing assembly 120, 130 above the bearing assemblies so that there is room to reach in the sheet feeder to remove sheets that become jammed or to access the shafts 40, 50, 60 and 70 for connecting them to the roller bearing shafts 140, 150, 160, and 170 respectively.

In the preferred embodiments the three-piece shafts have a split cylinder with opposing flat face surfaces 480 and 485 which are connected by collar 490 having apertures therein and screws or bolts inserted into apertures 470, 475 of the shaft ends.

Figure 7:
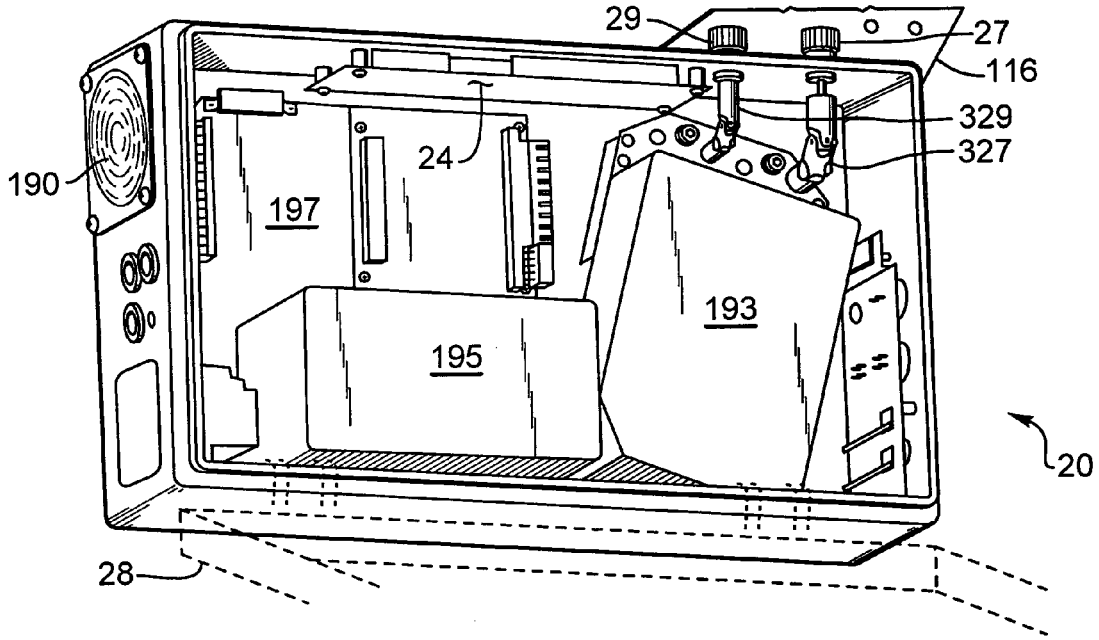
FIG. 7 is a perspective view of the inside of the right side housing.

The sheet feeder 10 is designed to be easily assembled and disassembled for ease of maintenance. The right side housing 20 and left side housing 30 have plates 116 attached and separator bars 115 therebetween to space the housings apart. As seen in FIGS. 7 and 8 access to the separated right side housing 20 is easy. Access door 28 is opened and the parts inside can be accessed. Each part inside the housing 20 and 30 are modular for easy replacement. For example the housing for the bearings 193 exposing the right bearing assembly 120 inside. The right bearing assembly 120 can be removed and replaced in its entirety to replace any of the parts inside. Similarly controller 195 is modular as is motherboard 197, display 24, or any of the indicator lights 26, keypads 22 or other parts.

Fan 190 can be used to provide cooling to the housing 120 and also keep a positive air pressure inside the housing to keep dirt and debris out helping to increase the life of the sheet feeder 10 and lower maintenance problems. The right side housing 130 is similarly accessible with modular bearing assembly 120 available for maintenance and replacement.

Figure 9:
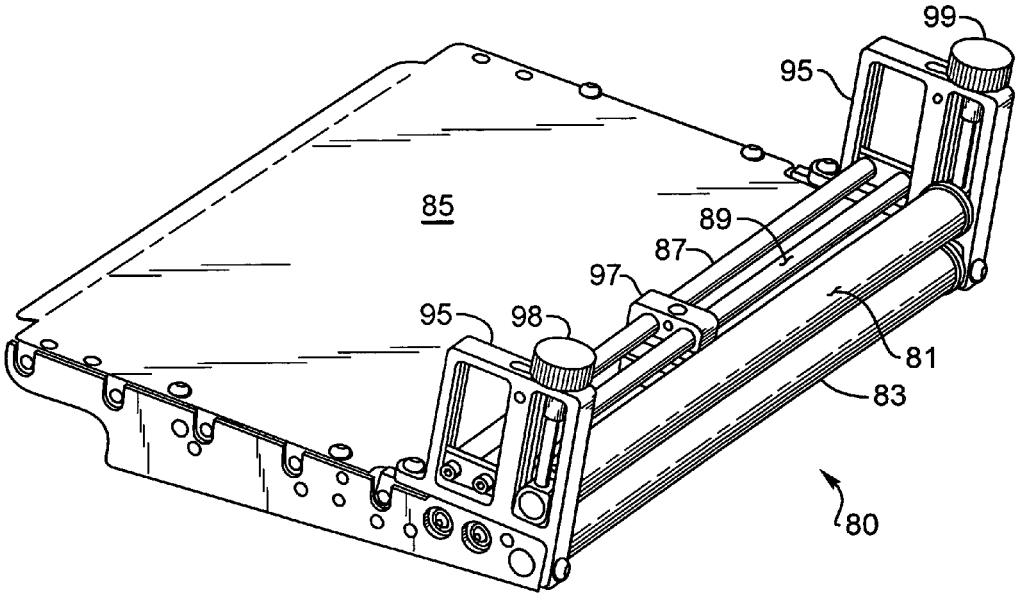
FIG. 9 is a perspective view of the discharge tray assembly.

The discharge tray 80 is attached to the sheet feeder 10 to guide the sheet materials being fed out of the sheet feeder. As best seen in FIG. 9 the sheet feeder 10 has opposing rollers 81 and 83, which have an adjustable gap by turning knobs 98 and 99 on frame 95. A sensor 97 is used to detect the presence of sheets and can be used for counting or other control features. The sensor is slidingly supported on rods 87 and 89 to that it can be positioned over any portion of the discharge tray and the rods 87 and 89 can be adjusted to different heights above the sheets being fed by raising or lowering the rods in frame 95.

The sensor 97 can have two parts a transmitter and a receiver for sensing the optical density of the sheets. The transmitter sends out infrared light at a high frequency and the receiver measures how much light is transmitted through the sheets thereby measuring the optical density of the matter between the transmitter and receiver portions of sensor 97. The sensor 97 can monitor the feeding process for preset optical densities and stop the process if the optical density changes from the preset limit range. A change in the optical density may indicate that two sheets of product are stuck together or some other anomaly.

The discharge tray has a tray surface 85 which preferably has a dimpled surface to reduce the surface area available for frictionally engaging the sheets or discharge belts 82, 84 and 86 passing thereover. The tray surface 85 is preferably curved to compensate for the sag of discharge belts 82, 84 and 86 used therewith. The discharge tray 80 is modularly attached and removed from the sheet feeder for ease of assembly and maintenance.

Although two opposing shafts are shown in the bearing housing, the housing may have one set of upper and lower shafts and a separate housing may contain a second set of upper and lower shafts. Alternatively the bearing housings can contain two or more upper and lower shafts depending on the device the adjustment mechanism is used in. The invention is shown installed on a sheet feeder but any device requiring an adjustable position shaft may benefit from the invention. The moveable shaft may oppose a fixed shaft or be used for any purpose such as supporting devices a specified distance from objects, or for engaging objects. With two or more shafts the shafts may be in any orientation the movable shaft may be in any position relative to the moveable shaft. Further, all of the bearing shafts in the housing may be positionable instead of just the upper bearing shafts as shown herein.

U.S. Pat. No. 6,050,563 issued Apr. 18, 2000 is attached hereto and incorporated herein by reference. The U.S. Pat. No. 6,050,563 has features used in the present application which are incorporated herein by reference.

Obviously, many modifications and variations of the present invention are possible in light of the above teachings. It is therefore to be understood that, within the scope of the appended claims, the invention may be practiced otherwise than as specifically described.

I claim:

1. A device having adjustable position shafts comprising:
- a first bearing assembly and a second bearing assembly spaced apart from the first bearing assembly, each bearing assembly having,
- a sliding block bearing shaft,
- a sliding block bearing for sliding up and down in the sliding block bearing shaft,
- a threaded shaft portion extending into each sliding block bearing,
- a ball screw inserted into the threaded shaft portion and engaging the bearing assembly for moving the sliding block bearing in the bearing housing shaft when the ball screw is rotated,
- a worm gear attached to the ball screw,
- a shaft having a thread thereon for engaging and turning the worm gear and rotating the ball screw to move the sliding block bearing in the sliding block bearing shaft of the bearing assembly when the shaft is rotated,
- a means for connecting the shafts in the first bearing assembly and the second bearing assembly such that both ball screws are turned simultaneously to raise and lower the sliding block bearings to the same position in the bearing assemblies at the same time.

2. A device having adjustable position shafts as in claim 1 including,
- a means for rotating the shafts to raise or lower the sliding block.

3. A device having adjustable position shafts as in claim 2 wherein,
- the means for connecting the shafts comprises a rod attached to the shaft in the first bearing assembly and to the shaft in the second bearing assembly.

4. A device having adjustable position shafts as in claim 1 including,
- a means for measuring the position of the sliding block bearing in the sliding block bearing shaft.

5. A device having adjustable position shafts as in claim 4 wherein,
- the means for measuring the position of the sliding bearing block comprises a potentiometer attached to the housing and a sliding contact on the potentiometer attached to the sliding bearing block.

6. A device having adjustable position shafts as in claim 5 including,
- a motor for rotating the shaft to raise or lower the sliding block.

7. A device having adjustable position shafts as in claim 6 including,
- a controller to run the motor for positioning the sliding bearing blocks to a desired position.

8. A device having adjustable position shafts as in claim 2 including,
- a knob attached to the shaft for rotating the shaft to raise or lower the sliding bearing blocks.

9. A device having adjustable position shafts as in claim 5 including,
- a display to indicate the position of the sliding bearing blocks.

10. A device having adjustable position shafts as in claim 1 wherein,
- a fixed bearing having a shaft therein fixed in position in the bearing assembly proximate the sliding block bearing shaft.

11. A device having adjustable position shafts as in claim 10 wherein, a shaft connecting the shafts on the fixed bearings so that both the shafts on the fixed bearings in the first bearing assembly and the second bearing housing rotate together.

12. A device having adjustable position shafts as in claim 10 including, a shaft in the sliding block bearings, and a shaft connecting the shafts in the sliding block bearings so that the shafts in the sliding block bearings rotate together.

13. A device having adjustable position shafts as in claim 1 including, springs extending between the sliding block bearing and the bearing assembly for loading the sliding block bearing.

14. A device having adjustable position shafts as in claim 1 including, the means for connecting the shafts comprises a rod attached to the shaft in the first bearing assembly and to the shaft in the second bearing assembly, a shaft connecting the shafts on the fixed bearings so that both the shafts on the fixed bearings in the first bearing assembly and the second bearing housing rotate together, a shaft in the sliding block bearings, and a shaft connecting the shafts in the sliding block bearings so that the shafts in the sliding block bearings rotate together.

15. A device having adjustable position shafts as in claim 14 including, a means for measuring the position of the sliding block bearing in the sliding block bearing shaft.

16. A device having adjustable position shafts as in claim 14 including, a crank mechanism to connect at least one shaft on one fixed bearing to a shaft on one sliding block bearing to a transfer power from the shaft on the fixed bearing to the shaft on the sliding block bearing over the range of positions of the sliding block bearing in the sliding block bearing shaft.

17. A device having adjustable position shafts as in claim 14 including, an idler block having an idler spur gear adjacent the bearing assembly, the center of the idler gear approximately at the center of the range of the sliding block bearing and a spur gear on the shaft of the sliding block bearing for engaging the idler spur gear as the sliding block bearing moves to any position in the sliding block bearing shaft such that the gears always mesh smoothly for a smooth power transfer.

18. A device having adjustable position shafts as in claim 16 including, an idler block having an idler spur gear adjacent the bearing assembly, the center of the idler gear approximately at the center of the range of the sliding block bearing and a spur gear on the shaft of the sliding block bearing for engaging the idler spur gear as the sliding block bearing moves to any position in the sliding block bearing shaft such that the gears always mesh smoothly for a smooth power transfer.

19. A device having adjustable position shafts as in claim 14 including, a discharge tray between the first and second bearing assemblies, the discharge tray having a dimpled discharge tray surface to reduce friction for objects transported over its surface.

20. A device having adjustable position shafts as in claim 19 wherein, the discharge tray surface has a curved surface to account for the sag of belts traveling over its surface to reduce drag.

* * * * *